US005474399A

United States Patent [19]

Chia-Hsiung

[11] Patent Number: 5,474,399

[45] Date of Patent: Dec. 12, 1995

[54] OPEN CUTTING BY FLOOR SLAB BRACED RETAINING WALL

[76] Inventor: Huang Chia-Hsiung, 3F, No. 22, Lane 89, Ku-Ling St., Taipei, Taiwan

[21] Appl. No.: 103,783

[22] Filed: Aug. 10, 1993

Related U.S. Application Data

[63] Continuation-in-part of Ser. No. 15,228, Feb. 9, 1993, abandoned.

[51] Int. Cl.[6] ..... E02D 27/00

[52] U.S. Cl. ..... 405/229; 405/133

[58] Field of Search ..... 405/133, 229, 405/230, 233, 249; 52/292, 294, 742

[56] References Cited

U.S. PATENT DOCUMENTS 4,938,634 7/1990 Lee ..... 405/229

5,135,328 8/1992 Chen ..... 405/229

5,197,827 3/1993 Lee ..... 405/229

5,228,805 7/1993 Chang ..... 405/229

*Primary Examiner*—David H. Corbin

[57] ABSTRACT

An open cutting to construct a raft foundation right after the first excavation, and to use the raft foundation as a work stage for constructing ground and basement floor slabs by fixing floor-forms to the top-slab thereof. As the raft foundation is lowered, the bracing appliance is fixed to the bottom slab of the raft foundation to give support to the retaining wall.

6 Claims, 17 Drawing Sheets

OPEN CUTTING BY FLOOR SLAB BRACED RETAINING WALL

CROSS-REFERENCE TO RELATED APPLICATION

The present invention is a continuation-in-part of patent application Ser. No. 015,228 filed on Feb. 9, 1993, now abandoned.

BACKGROUND OF THE INVENTION

This invention relates to foundation constructions and more particularly to an open cutting by floor slab braced retaining wall.

Different foundation excavation methods may be employed according to the structure of soil and the scale of excavation. An ordinary foundation excavation work is to construct the retaining wall then start the first floor excavation, and then to erect the first floor bracing frame to support the retaining wall. After the erection of the bracing frame, it proceeds to the second floor excavation and the erection of the second floor bracing frame to support the retaining wall. By repeating the aforesaid procedures, the foundation base is made. In practice, it is difficult and takes much time to erect underground bracing frames. During a foundation excavation process, the decompression of soil load results in bottom heave and retaining wall deformation movement. As the excavation process is proceeding, the subsidence of the land behind the retaining wall produces crannies in the land, thereby causing nearby buildings to be damaged. Therefore, the delay in erecting a bracing frame usually causes a foundation excavation work ended in failure. How to quickly erect bracing frames during a foundation excavation work, is a problem to be settled. According to conventional excavation methods, it is a cross complexity to erect bracing frames. Therefore, how to simplify the erection of a bracing frame is another problem to be settled.

This invention has been accomplished under the aforesaid circumstances. The main object of the present invention is to provide an open cutting by floor slab braced retaining wall which is easy and safe to be performed.

BRIEF DESCRIPTION OF THE DRAWINGS

FIG. 8-1 illustrates the bracing appliance fixed to the bottom slab of the raft foundation;

FIG. 8-2 illustrates the bracing appliance installed between the raft foundation and the retaining wall;

FIGS. 9-1 and 9-2 illustrate two different forms of the beams to which the bearing columns connected;

FIG. 12-1 illustrates the prestressing tendons 72 clamped by the lower wedges 7130, the lower spring 7110 is compressed, the load supported on the lower anchor 7150, the upper wedges 713 released;

FIG. 12-2 illustrates the upper locating board 714 lifted by the respective upper locating jack 716 to carry the upper wedges 713 upwards at distance 15 cm while the upper pressure board 712 spaced from the upper wedges 713;

FIG. 12-3 illustrates the upper locating jack 716 moved back to return the upper locating board 714 while the upper wedges 713 spaced from the upper anchor 715 at distance 15 cm;

FIG. 12-4 illustrates the master jack 717 extended out at distance over 15 cm, the lower spring 7110 is released, the upper wedges 713 compressed by the upper pressure board 712 to clamp on the prestressing tendons, and the load gradually shifted to the upper anchor 715;

FIG. 12-5 illustrates the master jack 717 extended out at distance 20 cm, the upper spring 711 is compressed, the load supported on the upper anchor 715, and the lower 7130 released;

FIG. 12-6 illustrates the lower locating jack 7160 extended out at distance 15 cm to move the lower wedges 7130 into proper position;

FIG. 12-7 illustrates the lower locating jack 7160 returned to it's original position;

FIG. 12-8 illustrates the master jack 717 moved back, the upper spring 711 is released, the prestressing tendons 72 lowered, and the raft foundation lowered. The master jack 717 moved back at distance over 15 cm then the lower wedges 7130 slowly clamped on the prestressing tendons 72, the load gradually shifted to the lower anchor 7150.

DETAILED DESCRIPTION OF THE PREFERRED EMBODIMENT

The present invention includes:

Step 1: Constructing retaining walls, bored concrete piles and bearing columns;

Step 2: Starting the first excavation;

Step 3: Constructing raft foundation;

Step 4: Fixing bracing appliances, floor-forms, suspension appliances;

Step 5: Constructing ground floor slab;

Step 6: Starting excavation;

Step 7: Lowering raft foundation;

Step 8: Bracing raft foundation;

Step 9: Constructing a basement floor; and

Step 10: Repeating the aforesaid steps 6 6 through 9 until finished; in the meantime constructing vertical structure like walls and columns according to the progress of the work.

Figure 1:
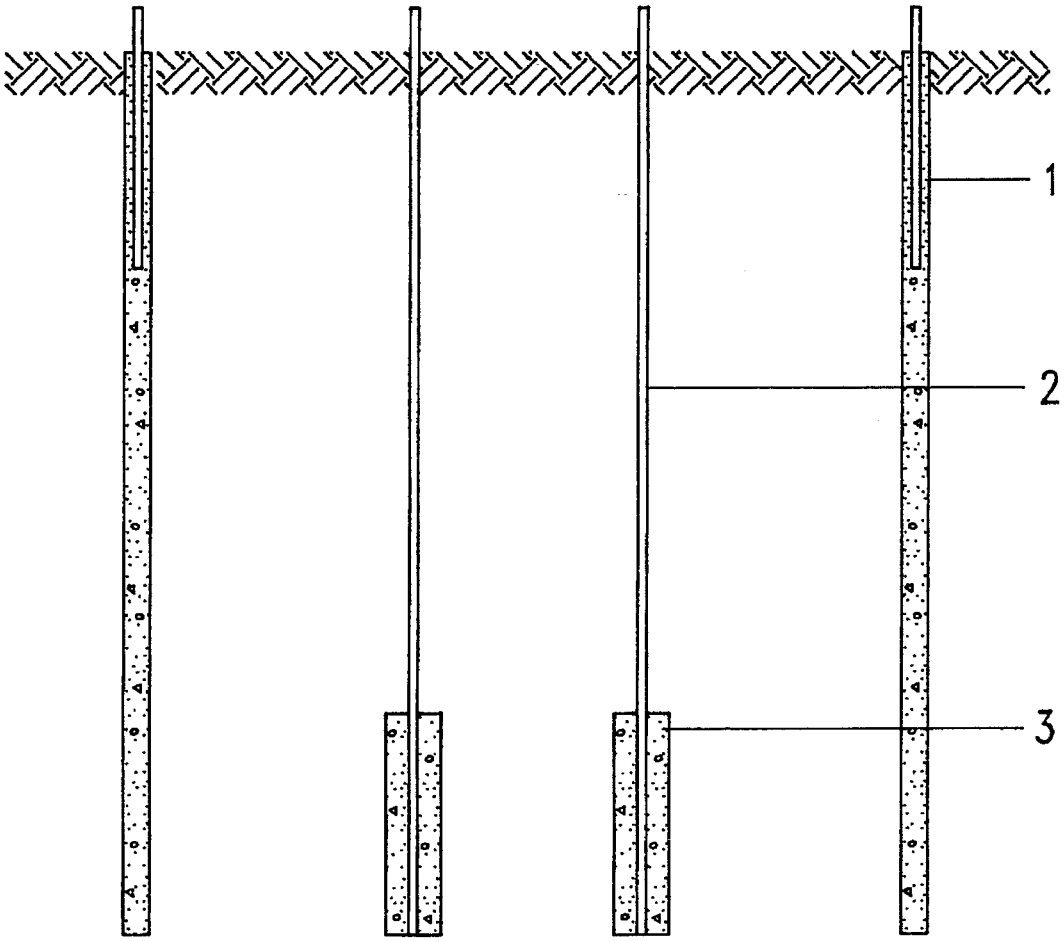
FIG. 1 illustrates the relative positions of the retaining wall and the bearing columns.

The aforesaid steps are now described in detail. Referring to FIG. 1, a retaining wall 1 is constructed first. The retaining wall 1 is constructed according to the nature of soil and ground water level, and it can be a soldier pile, steel sheet pile, concrete diaphragm wall. The retaining wall is used to keep the stability of the land and prevent it from collapsing, and to transmit the load to the base. Bearing columns 2 are then constructed. The bearing columns 2 are made by constructing bored concrete piles 3 in the center of the columns of the building and then fixing steel columns in the center of the bored concrete piles respectively. Before the raft foundation can support the load of the building, the bearing columns are used for allowing the load of the building to be transmitted to the bored concrete piles 3.

Figure 2:
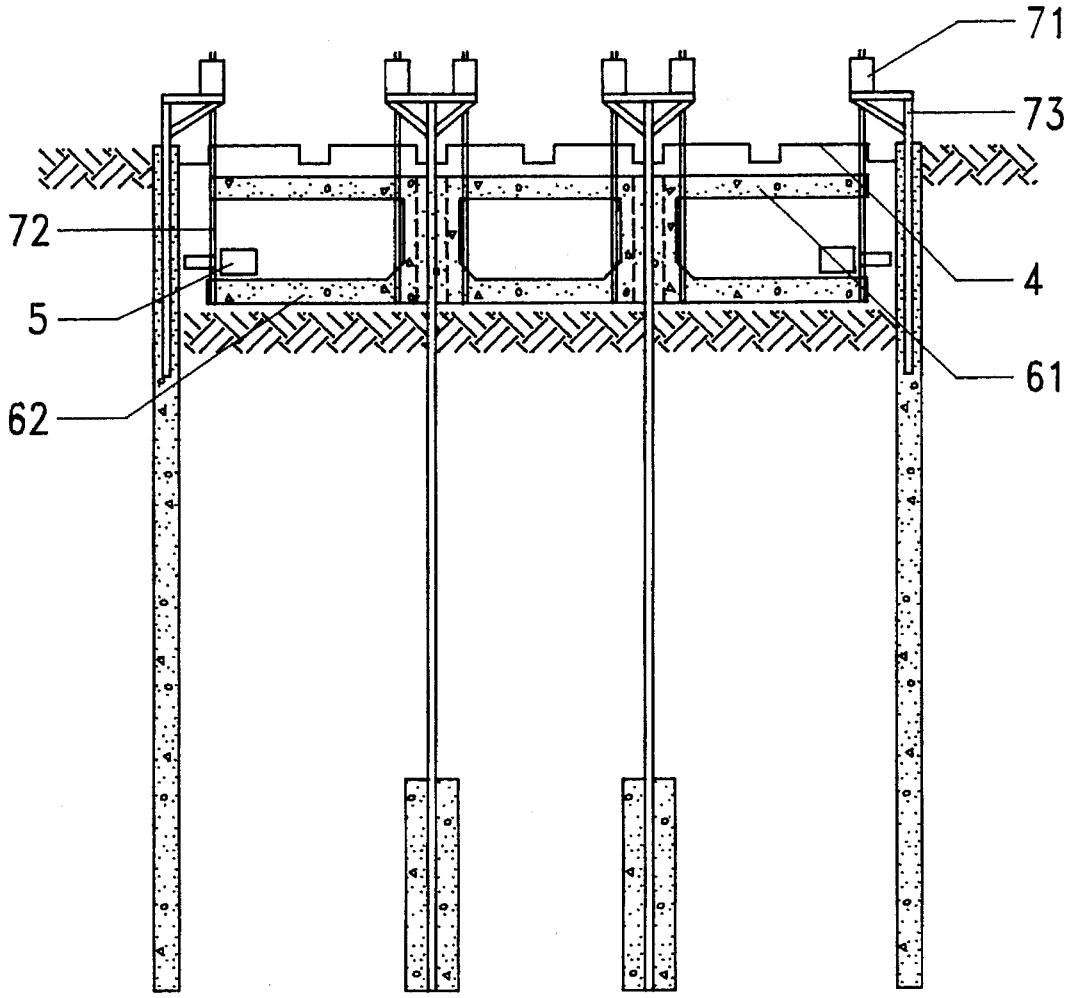
FIG. 2 illustrates the first excavation executed, the raft foundation constructed, the bracing appliance, suspension appliance, and floor-forms installed.

Referring to FIG. 2, the first excavation is started after the retaining wall 1, bearing columns 2, and bored concrete piles 3 were finished, and then the raft foundation 6 is made. After the construction of the raft foundation 6, floor-forms 4 are fixed to the top-slab 61 of the raft foundation 6, and bracing appliance 5 is fixed to the bottom-slab 62 thereof. During the construction of the raft foundation 6, a big opening should be left for access control and passing a backhoe. Holes are maintained through the raft foundation 6 to separate the bearing columns 2 from the raft foundation 6. The border of the raft foundation 6 should be separated from the retaining wall 1 to prevent contact between the raft foundation 6 and the retaining wall 1. The precision of the bearing columns 2 is normally within 1/300, namely, the deviation of the bearing columns 2 must be within about 7 cm if the depth of the excavation is at 20 meters. Therefore, the raft foundation does not touch the bearing columns during its lowering procedure if the bearing columns are spaced from the raft foundation edge at least 15 cm.

Figures 1, 9:
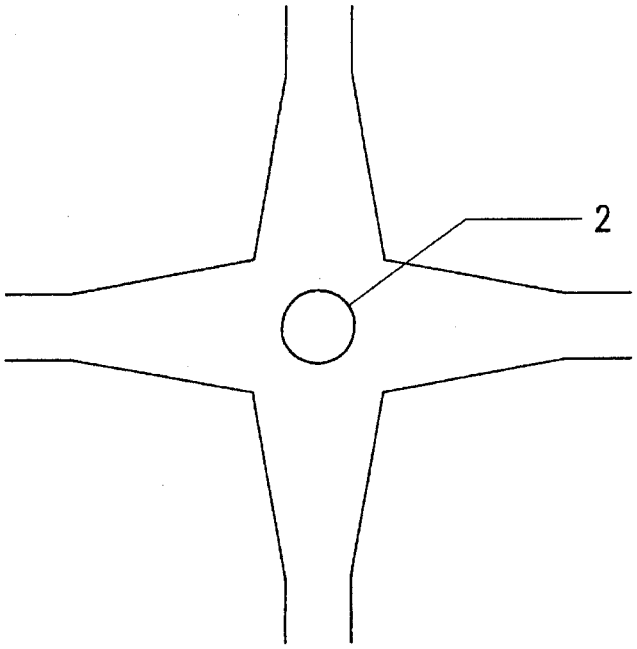
Figures 2, 9:
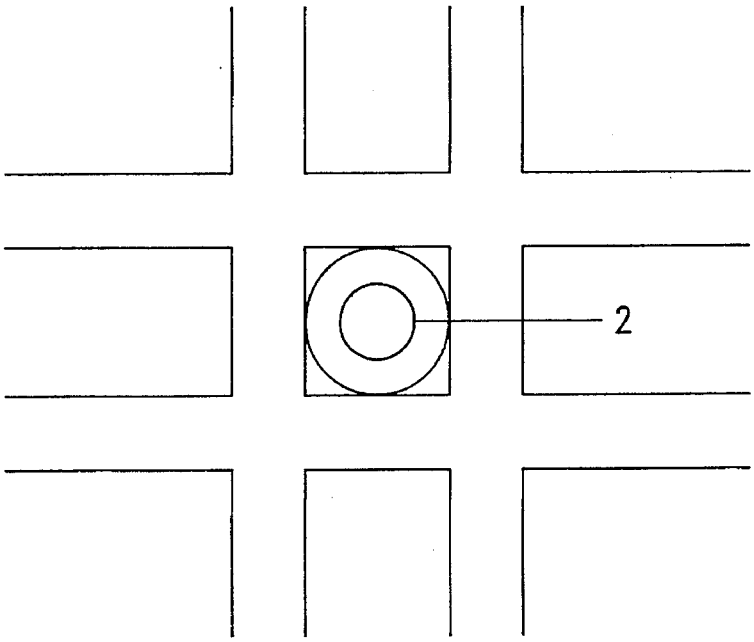

Referring to FIG. 9-2, the openings on the raft foundation for the bearing columns are big. Therefore, the ground beam of the raft foundation may be made in the shape of "#" with the opening made in the center for passing the respective bearing column. The border of the raft foundation must be separated from the retaining wall at a suitable distance to avoid contacting. If the retaining wall is formed of a continuous concrete diaphragm wall, the amount of deviation may be about 7 cm as the depth of the excavation is made at 20 meters. As the amount of deformation of the continuous concrete diaphragm wall may be about 15 cm as the depth of the excavation reaches 20 meters, plus the spacing for installing bracing appliances, therefore the distance between the raft foundation and the retaining wall must be kept 40 cm minimum.

Figures 1, 8:
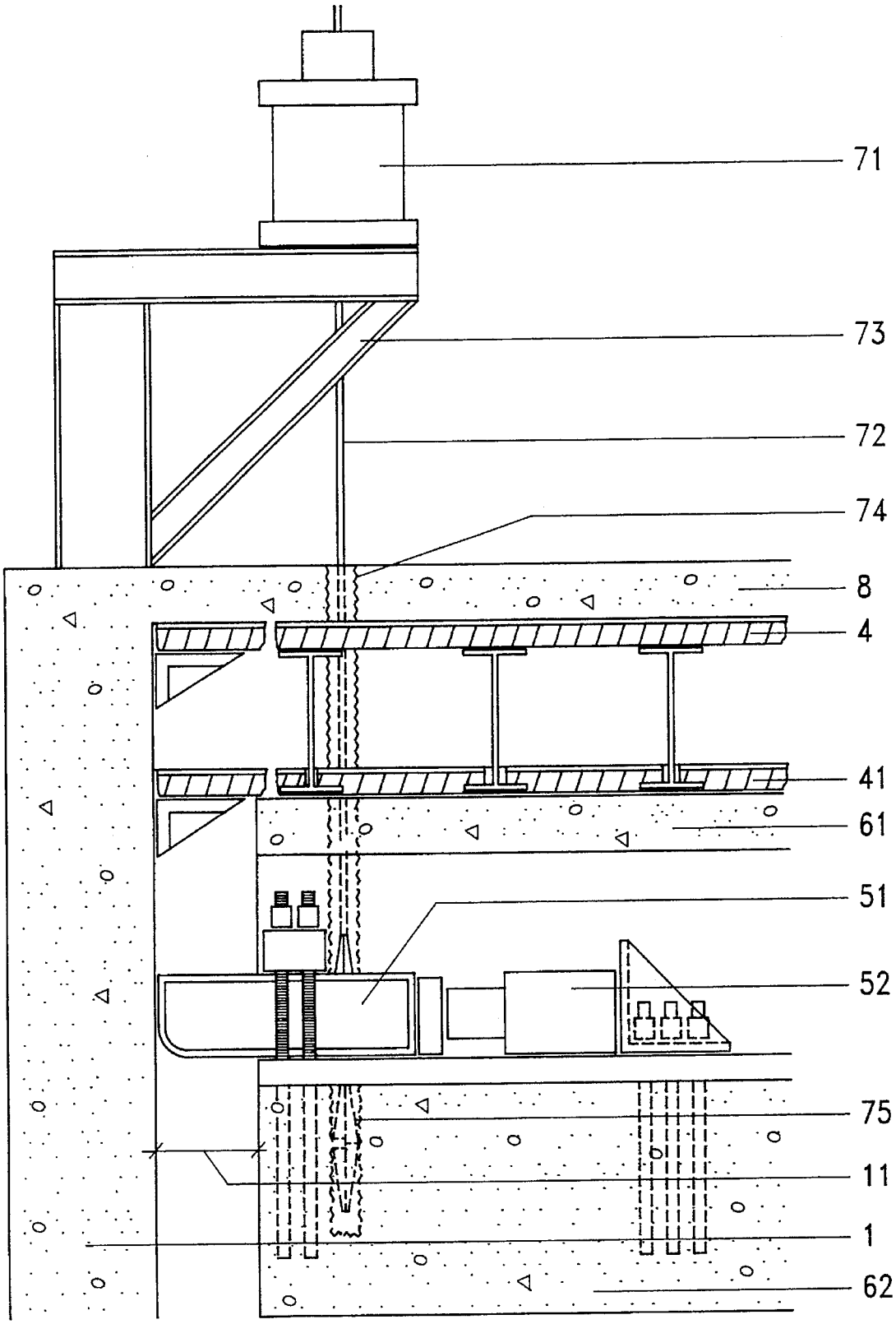
Figures 2, 8:
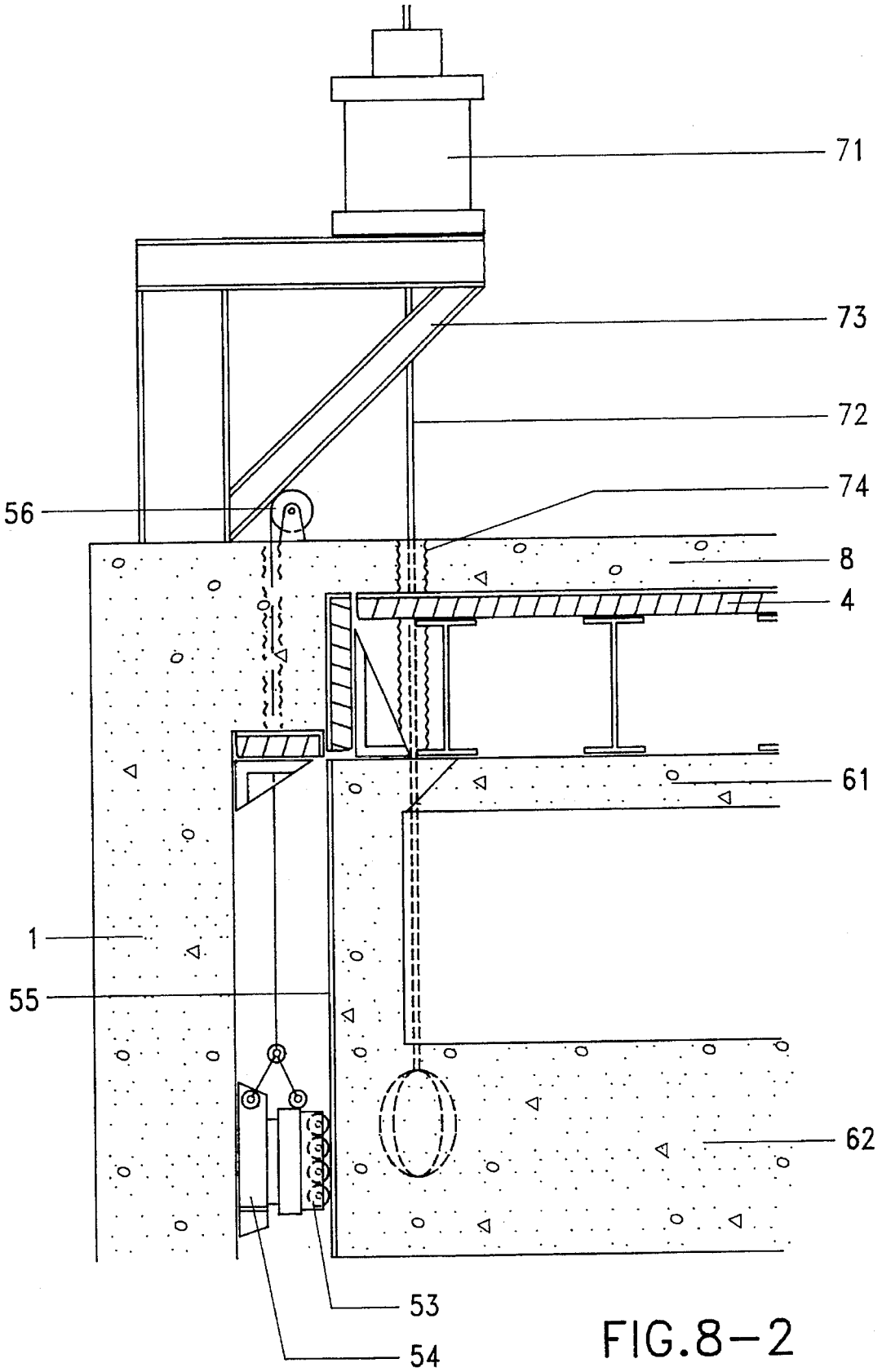

Referring to FIG. 8-1, the bracing appliance 5 is assembled with H-beams 51 and oil jacks 52, and fixed to the bottom-slab 62 of the raft foundation 6. The bracing position of the bracing appliance 5 is moved as the raft foundation 6 is lowered, and therefore the retaining wall 1 is firmly supported.

Referring to FIG. 8-2, the bracing appliance is installed between the retaining wall and the raft foundation. It is consisted of oil jacks 54 and rollers 53. Steel rails 55 are made on the raft foundation along the route in which the rollers 53 to be moved. Therefore, the coefficient of friction between the bracing appliance and the retaining wall is always bigger than that between the bracing appliance and the raft foundation, and the bracing appliance can be suspended by a steel rope which is driven by sheaves 56 for allowing the position of the bracing appliance to be conveniently adjusted and fixed. As the raft foundation is lowered, the oil jacks 54 provide a constant pressure to continuously support the retaining wall. In the known excavation methods, the lateral pressure of the retaining wall is supported by the soil below the excavating surface and the bracing structure installed above. The excavating area becomes unstable because of reduced load. Therefore, the excavating area must be quickly supported. According to conventional methods, it takes about 7 to 10 days to install the bracing structure to support the retaining wall. If a reversed excavation method (somebody calls upper-down method) employed, it takes more than 30 days to install the floor slab supporting frames and finish the floor slab for supporting the retaining wall. When the present method is employed, the upper floor slab is finished as the excavation is completed, and the finished floor slab is strong enough to support the retaining wall. When the raft foundation bracing appliance is released, the floor slab above the top slab of the raft foundation is completed to support the retaining wall, therefore the raft foundation could be lowered rapidly to support the next lower level. The bracing work can be completed within about half day after the excavation is made. The oil-jacks 52 of each bracing appliance are respectively connected to an oil pump through an oil hose (they can also be separately controlled). Therefore, the pressure or the oil-jacks can be conveniently controlled according to the load. During the raft foundation lowering operation, the pressure of the oil-jacks is adjusted to zero, then the H-beams 51 are moved inwards from the retaining wall for allowing the raft foundation to be lowered. The pressure of the oil-jacks may be maintained at a fixed range to keep the H-beams in contact with the retaining wall so that the raft foundation continuously supports the retaining wall as it is lowered.

Figure 3:
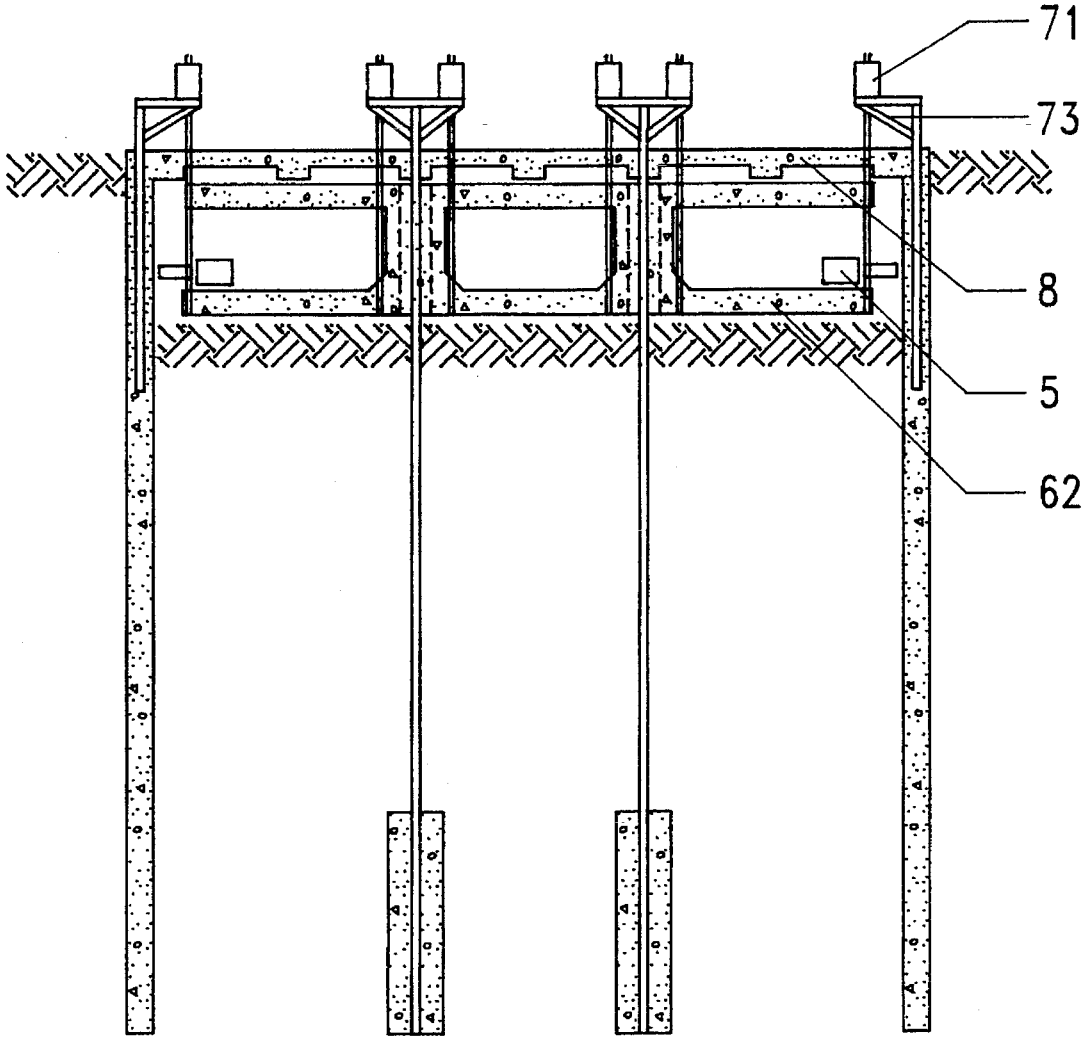
FIG. 3 illustrates the ground floor slab finished.

Referring to FIG. 3, the ground floor slab 8 is constructed on the floor-forms 4, and therefore the ground floor slab 8, the bearing columns 2, and the retaining wall 1 are combined together. Once the ground floor slab 8 was finished, it supports the retaining wall 1 to prevent the lateral movement of the retaining wall 1, and is used for fixing the bearing columns 2 and placing construction materials, or used as a job-site for permitting the underground works to be proceeded without being affected by the action of the weather. The suspension appliance 7 consists of hollow jacks 71, and prestressing tendons 72. The hollow jacks 71 are respectively fixed to the brackets 73 on the bearing columns. The prestressing tendons 72 are respectively fastened between the hollow jacks 71 and the ground beam 63 of the raft foundation.

Referring to FIG. 9-1, during the construction of each floor slab, the beam may be made in a tapered configuration, namely, the connecting area between the beam and the bearing columns may be increased at a ration of 1:6 so that the reinforcing steels for the beam can be passed through the bearing columns; or the reinforcing steels for the beam may be directly welded to the bearing columns; or the reinforcing steels for the beam may be arranged within ¼ of the thickness of the side board of the beam; or the aforesaid methods may be employed simultaneously. The reinforcing steels for the columns are arranged according to conventional methods, with two opposite ends respectively projected over a suitable length for binding, or reinforcing steel couplings may be fastened to the reinforcing steels for the columns in advance.

Figure 7:
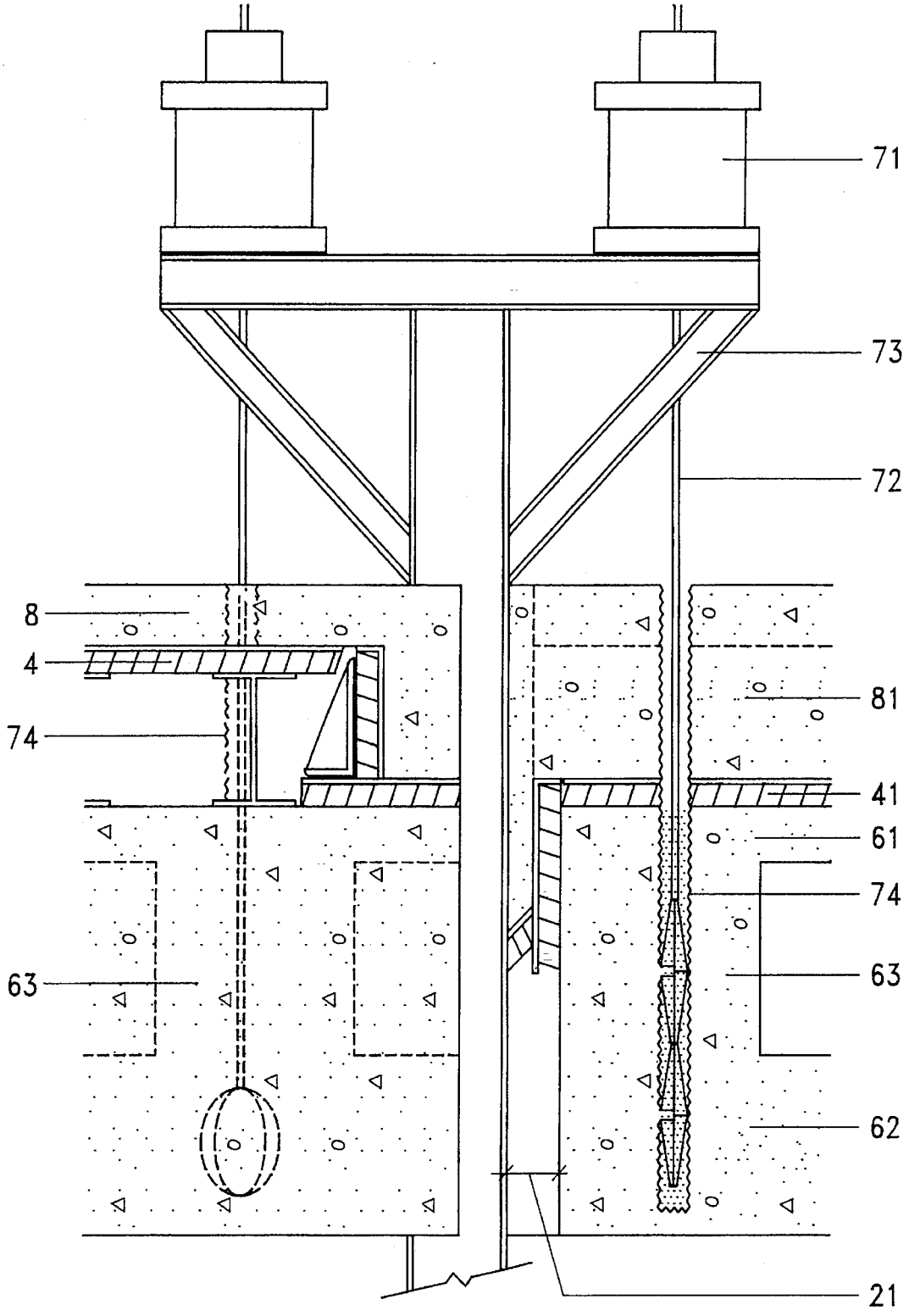
FIG. 7 illustrates the hollow jacks installed in brackets above the bearing columns, and the prestressing tendons fastened to the raft foundation.

Referring to FIG. 7, the prestressing tendons must be cut in length according to the depth of the excavation. The length of the prestressing tendons must be equal to the combined length of the excavation depth and the anchor of the raft foundation and the holding length or the hollow jacks. The anchoring end of the prestressing tendons can be fixed in place by many ways. The anchoring end of the prestressing tendons may be arranged into a loop and then embedded within the ground beam 63 of the raft foundation. Otherwise, screw tubes 74 may be embedded within the raft foundation for inserting the prestressing tendons, and then the tendons are fixed to the raft foundation by pouring concrete into the screw tubes 74. Mechanical anchors may be alternatively used to fix the prestressing tendons to the raft foundation.

Figures 2, 12:
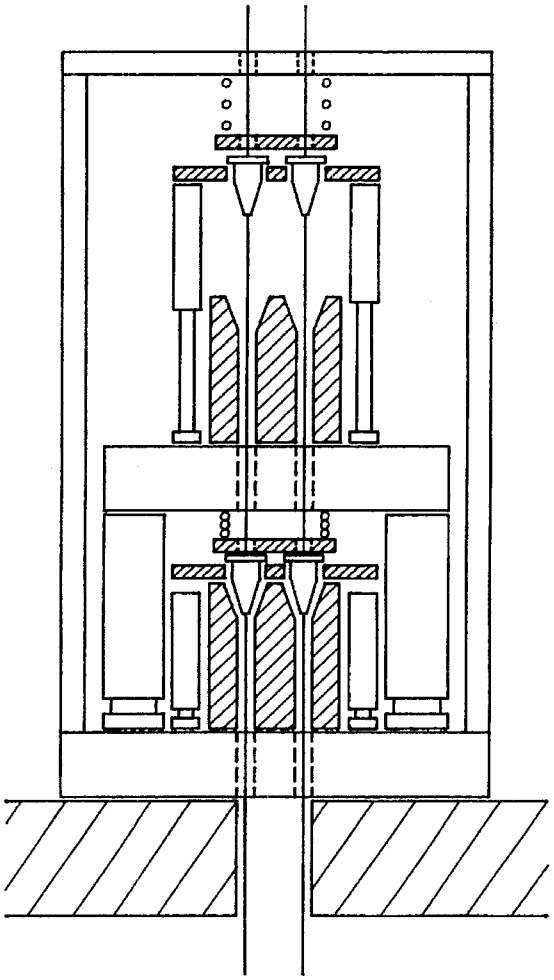
Figures 1, 12:
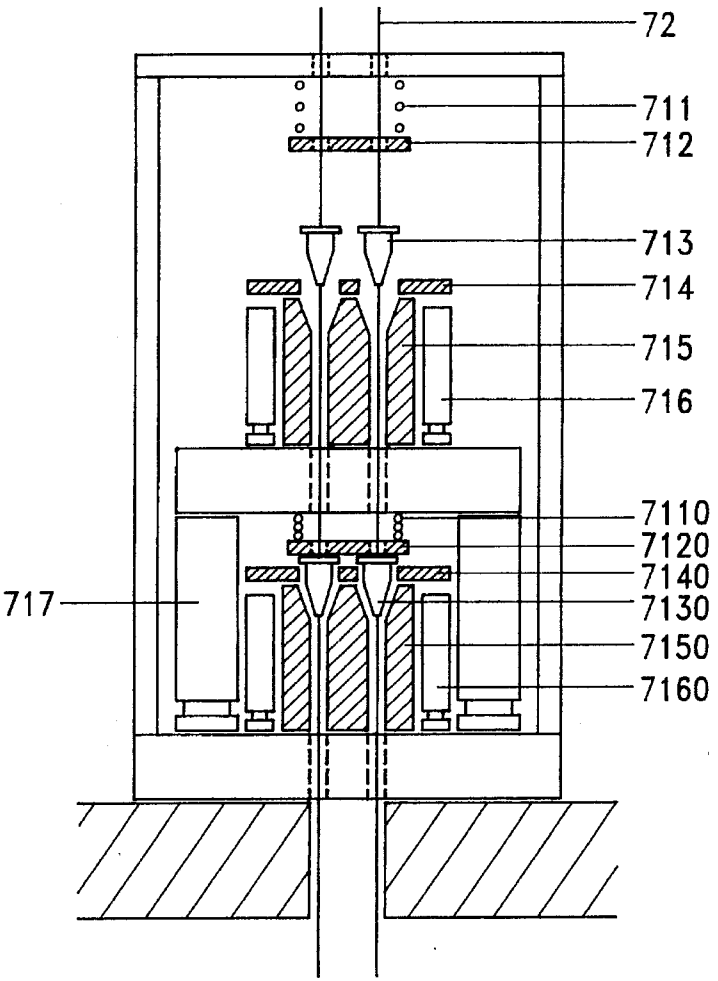
Figures 4, 12:
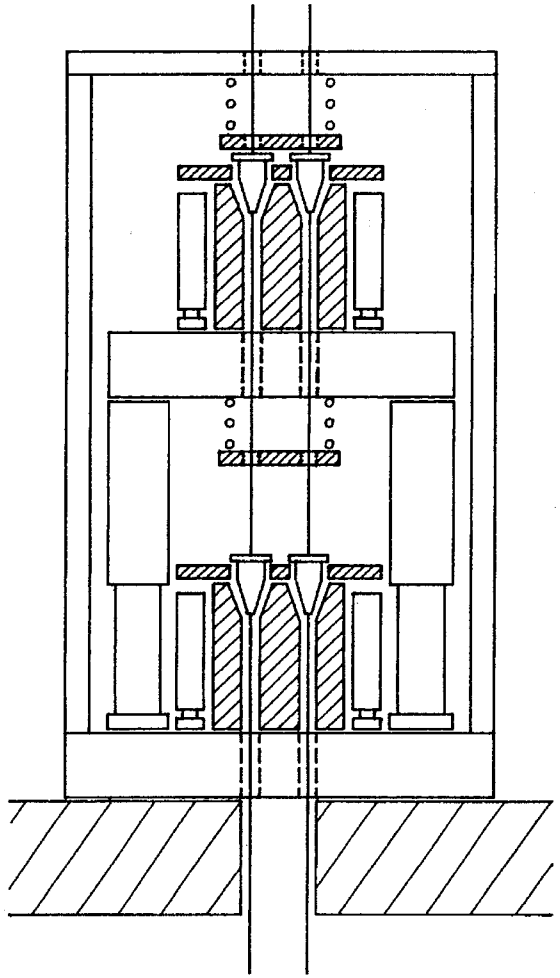
Figures 3, 12:
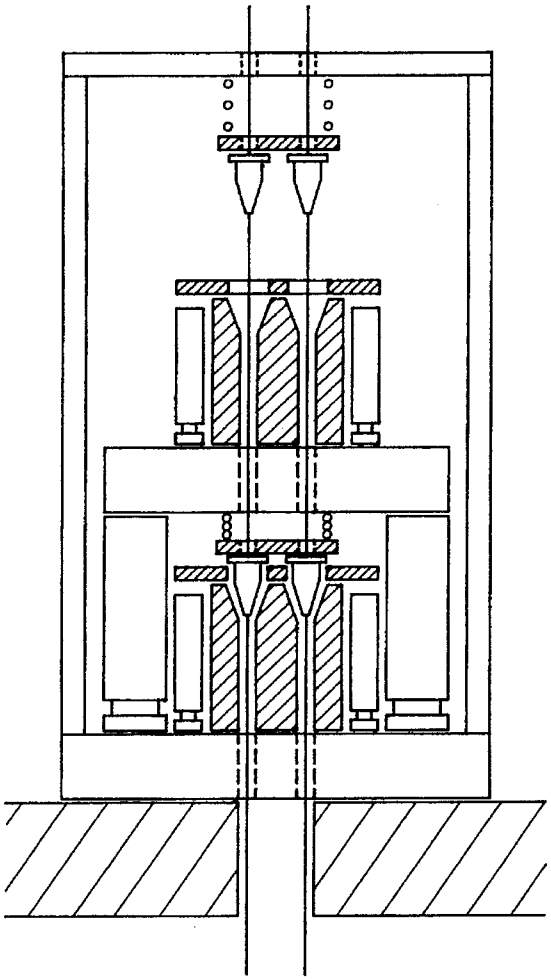
Figures 6, 12:
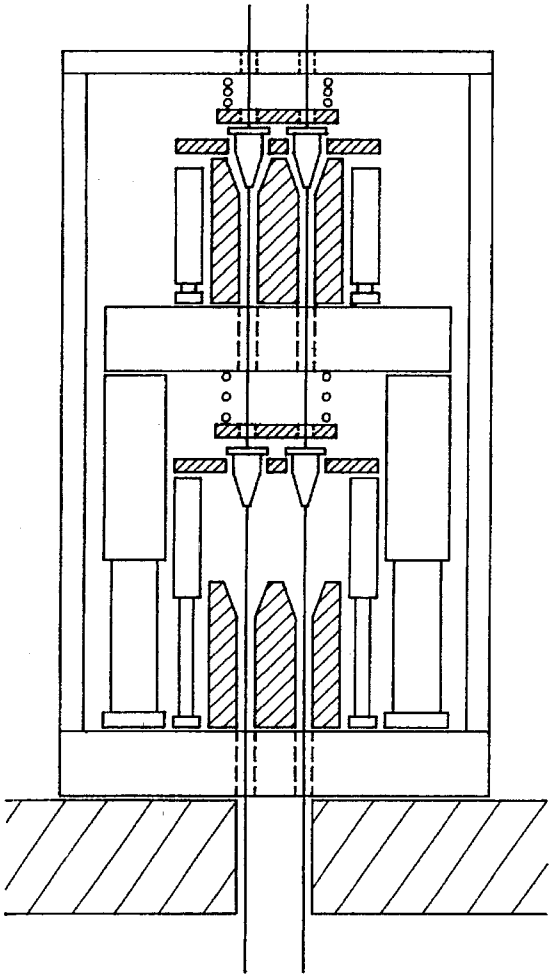
Figures 5, 12:
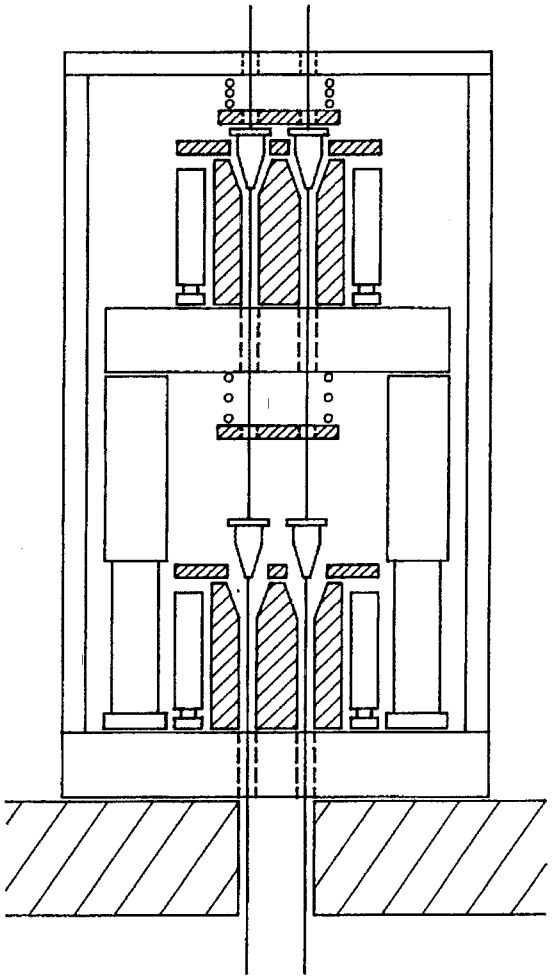
Figures 8, 12:
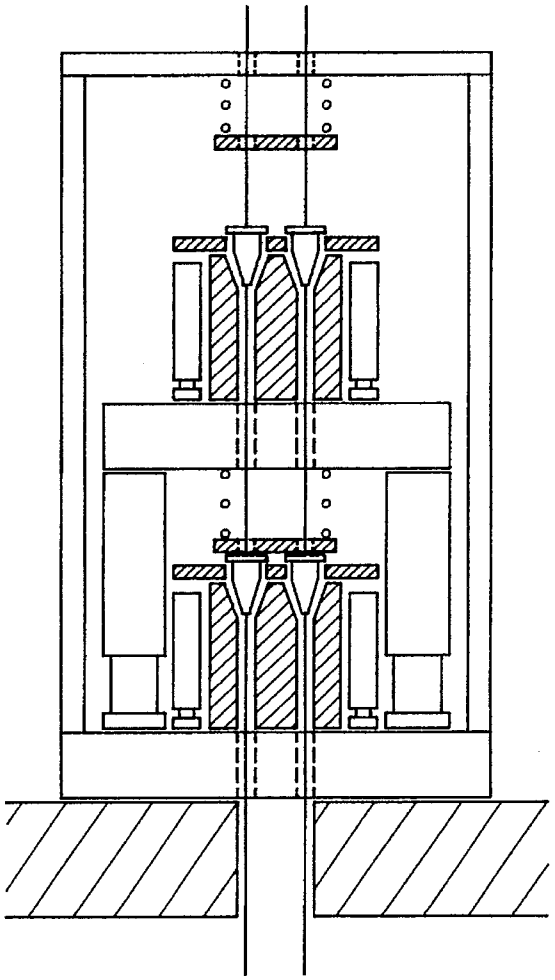
Figures 7, 12:
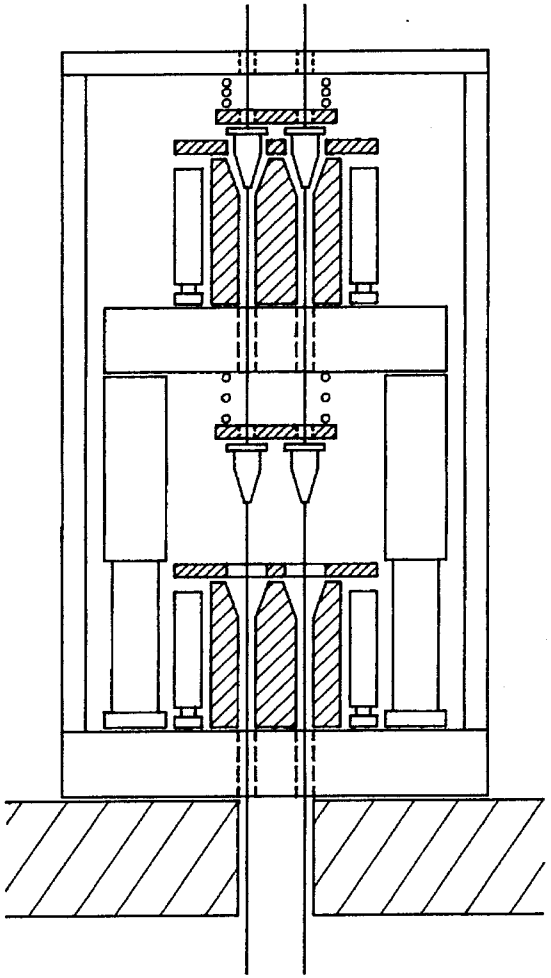
Figure 13:
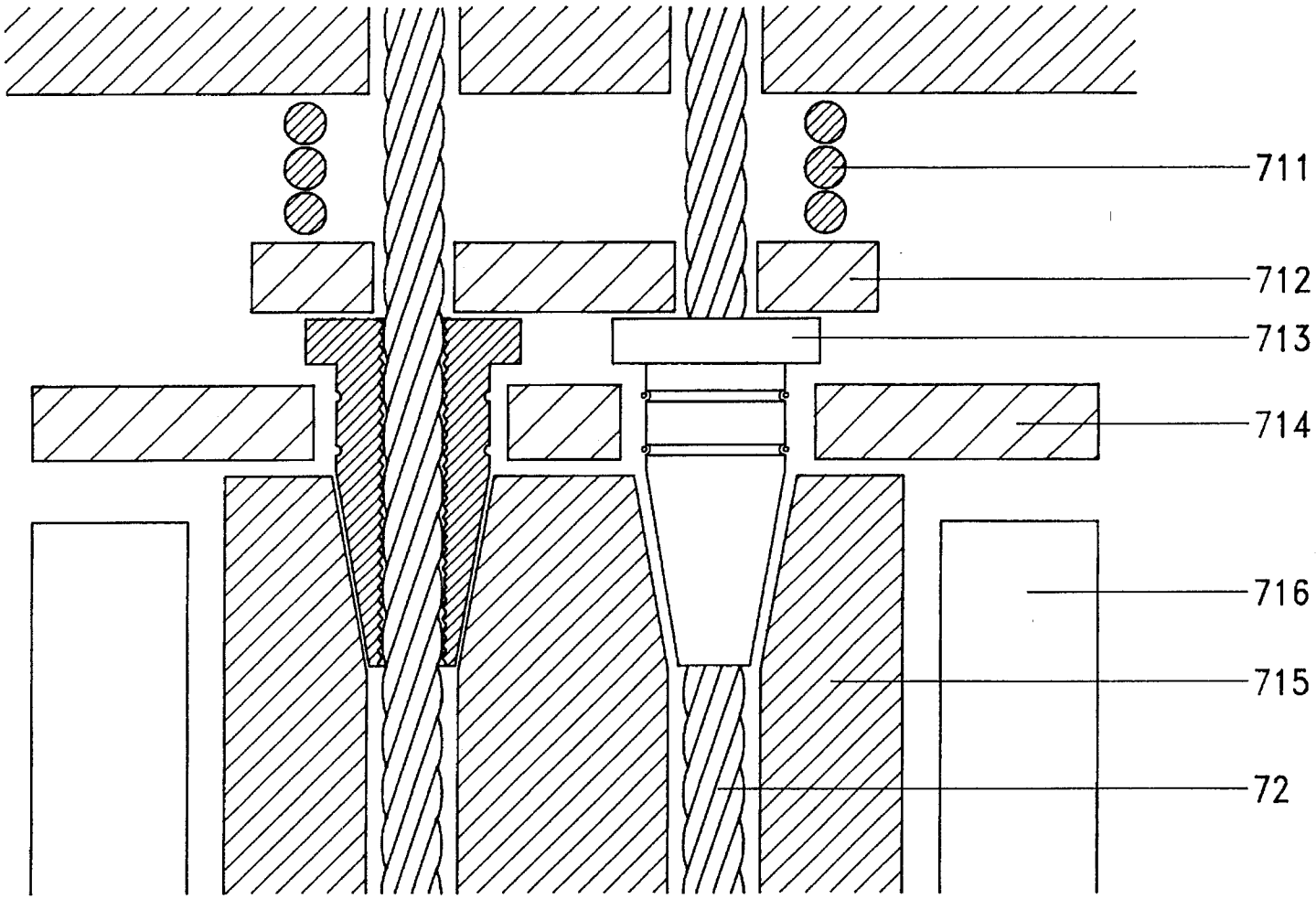
FIG. 13 illustrates the structure of the wedges and the anchors in detail.

Referring to FIGS. 12-1 through 12-8, the prestressing tendons are moved into the hollow jacks from the top and then moved out of the hollow jacks from the bottom. One operating cycle causes the prestressing tendons to be lowered 10 cm. Either upper wedges or lower wedges clamping on the prestressing tendons as the hollow jacks are operated. By means of repeating the operation of the hollow jacks, the raft foundation can be quickly lowered to the predetermined position.

Figure 11:
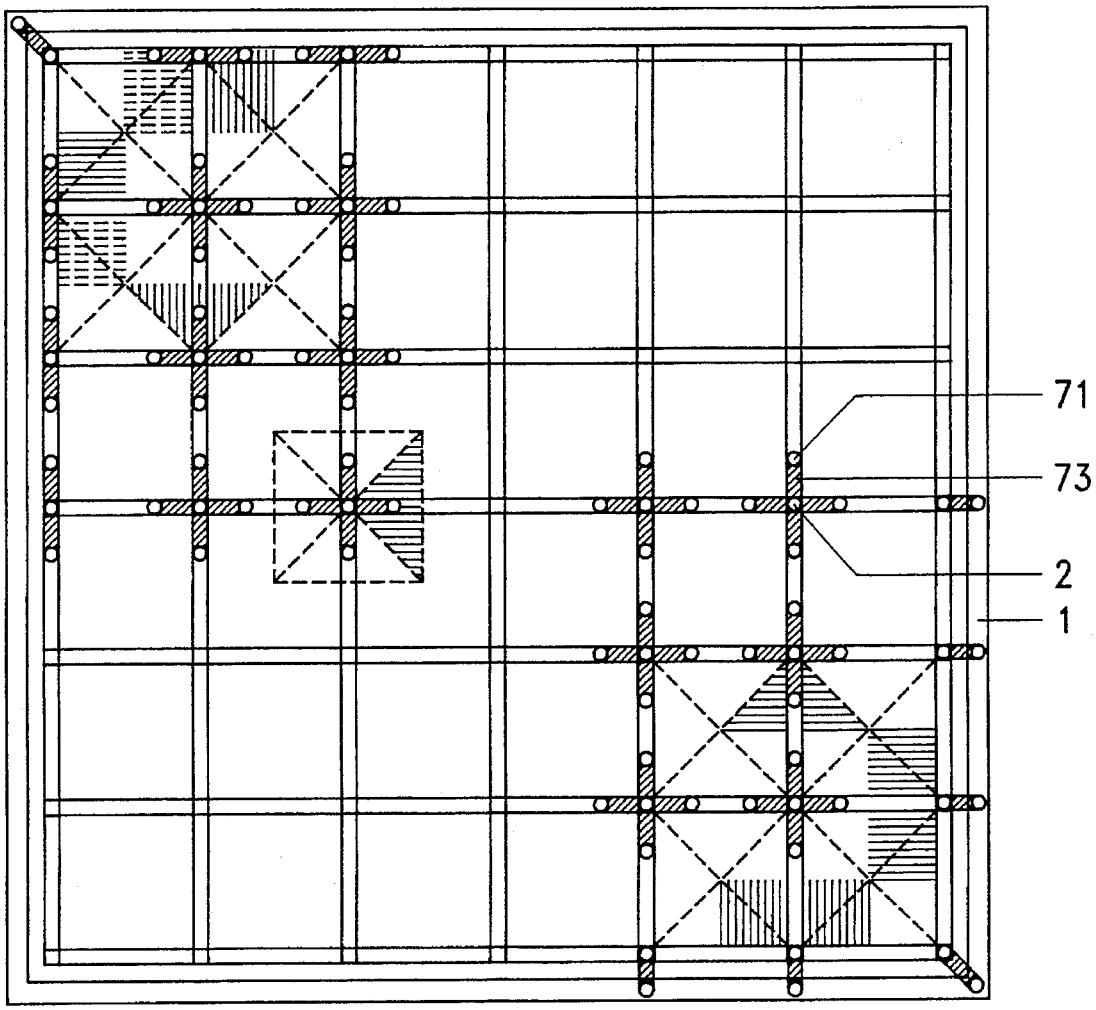
FIG. 11 is a plain view showing the arrangement of the suspension appliance.

Referring to FIG. 11, therein illustrated is a plain view showing the arrangement of the suspension appliance. From the layout, the load to be distributed to the hollow jacks at different locations is respectively calculated. The lifting load of each hollow jack is equal to the respective piston area multiple the oil pressure. Therefore, the piston area of each hollow jack can be determined according to the load to be born.

Figure 10:
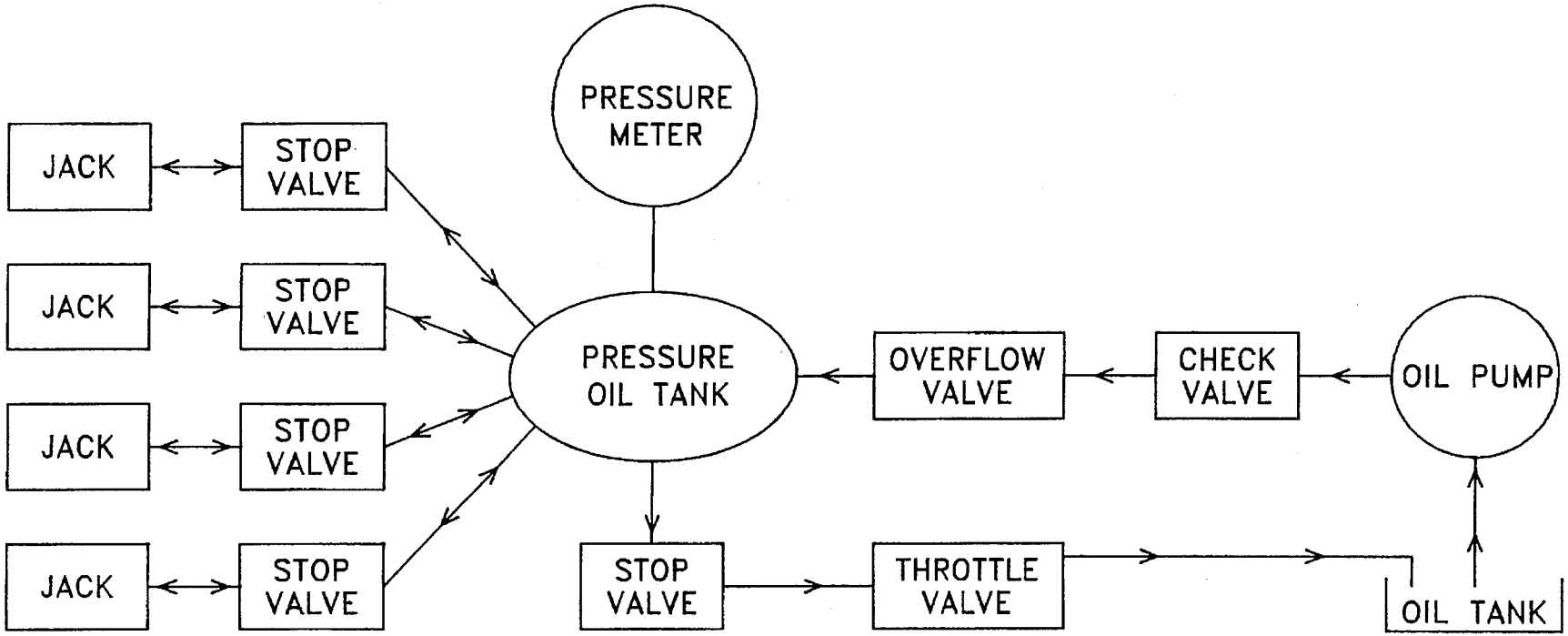
FIG. 10 is an oil loop circulating flow chart of the hollow jacks and the bracing jacks.

Referring to FIG. 10, therein illustrated is an oil loop circulating flow chart of the hollow jacks and the bracing jacks. Through oil hoses of same diameter and length at a low flowing speed, each jack and the pressure oil tank have the same pressure. Different loads are respectively moved by using the same pressure to move pistons of different sizes. By means of the oil loop, all hollow jacks 71 are synchronously operated. The oil pressure system bears the load only when the hollow hole jacks are operated, that is, it bears the load when lowering the raft foundation. If an oil leakage is occured during the lowering operation of the raft foundation, the hollow jacks become unable to extend, and no danger will be made of the suspension system. The damage could be repaired and operation could be proceeding again.

Figure 4:
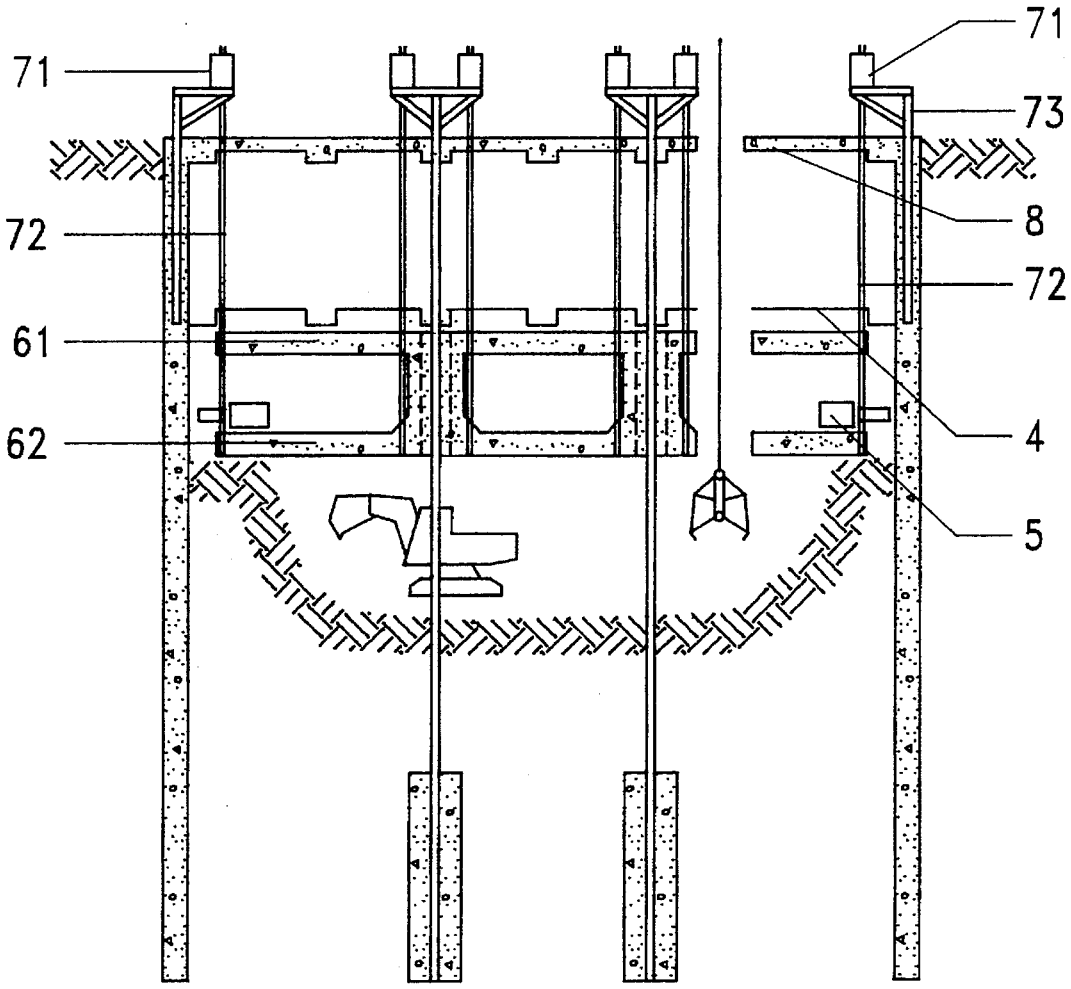
FIGS. 4 and 5 illustrate the open cutting undergoing.
Figure 5:
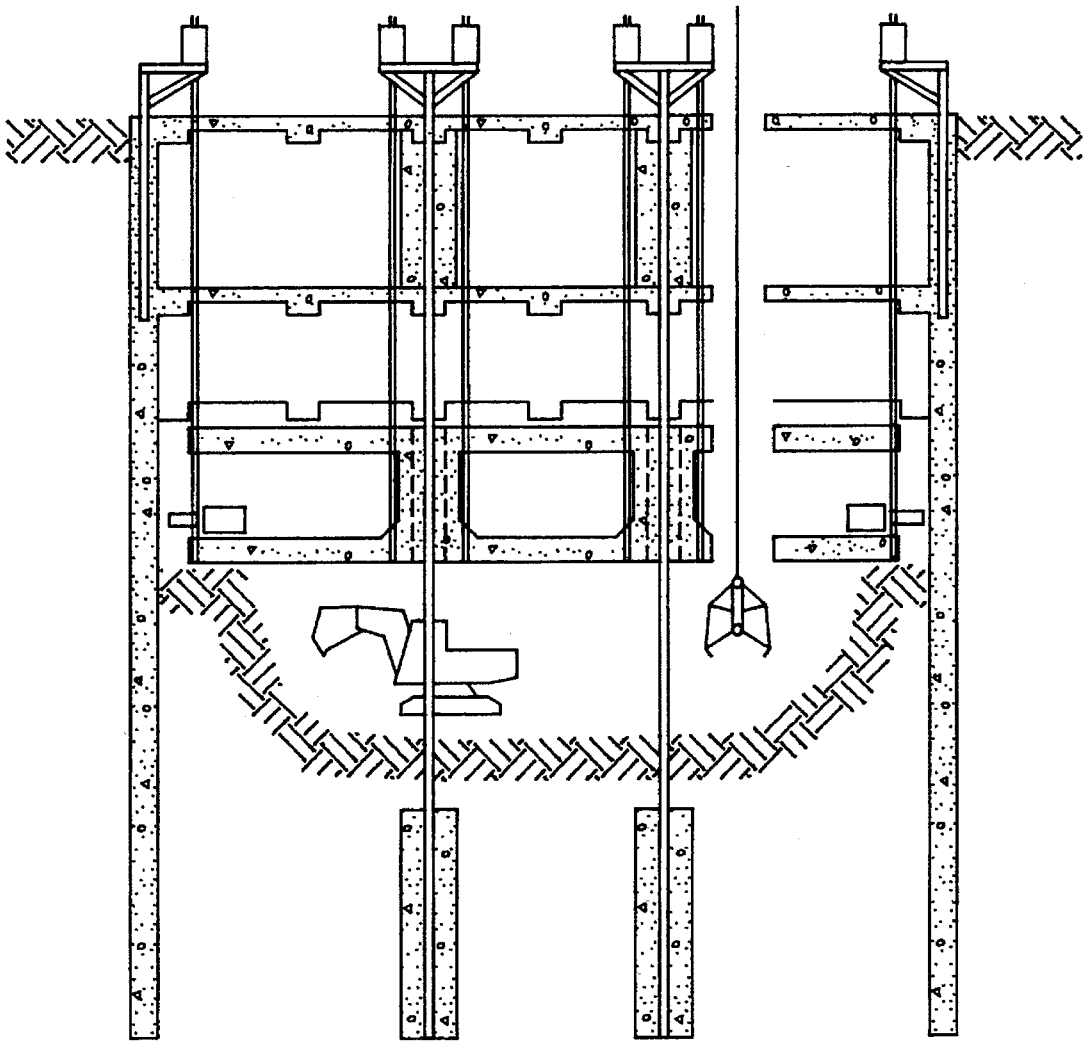
Figure 6:
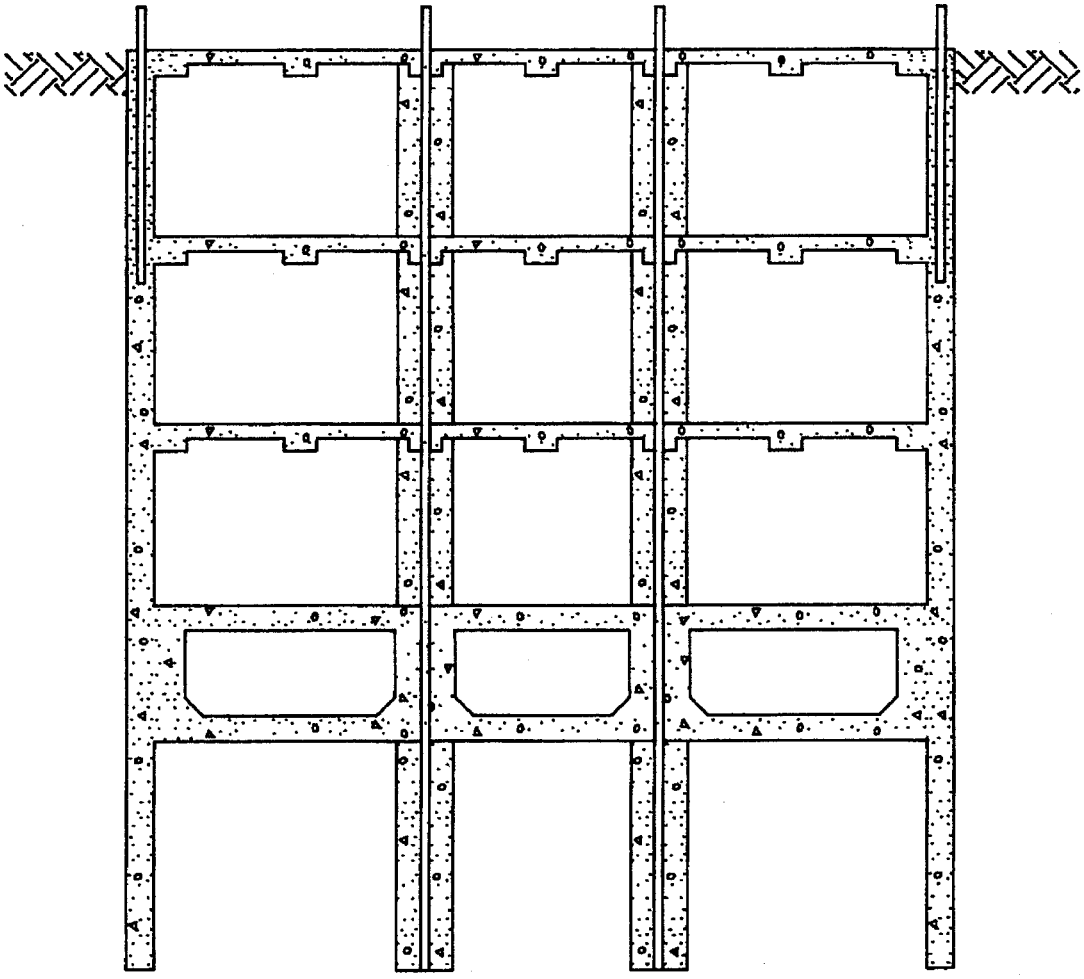
FIG. 6 illustrates the basement constructed.

Referring to FIGS. 4 and 5, during the construction of each floor slab, a big opening should be maintained through which a clamshell grab digs in vertical direction, and then a backhoe is carried in through the big opening to make a basement excavation. The lowering of the raft foundation is operated through the suspension appliance. The suspension appliance is operated through a synchronizing control so that the raft foundation can be stably lowered to the predetermined position. As the raft foundation was lowered, the floor-forms on the top slab of the raft foundation is simultaneously carried downward and separated from the completed floor slab. Therefore, it is not necessary to pull down and remove the forms and then repeatedly make up the forms, and the floor-forms are kept for use repeatedly. This arrangement greatly reduces material consumptions and labor expenses.

As indicated, this invention uses the floor-forms 4 on the top-slab 61 of the raft foundation 6 to construct different basement floor slabs. Therefore, the procedure is simplified, the work amount is greatly reduced, and the construction speed is accelerated. Because the raft foundation 6 is used as a work stage, it provides high rigidity and stability for a safety operation.

During the construction of a floor slab, the excavation operation is still under going, and the floor slab can be simultaneously treated through a steam curing process, and therefore the next raft foundation lowering operation can be executed in time. As soon as the excavation reaches the predetermined depth for the foundation base, a 15 cm concrete blinding layer shall be made to smoothen the excavation surface. After the 15 cm concrete blinding layer was made, the raft foundation 6 is rapidly lowered to the foundation base. By means of the weight of the raft foundation 6, the conditions of bottom heave, rebound, and movement of retaining wall are restrained.

The open cutting by floor slab braced retaining wall as described above provides numerous advantages as outlined hereinafter.

1. The equipment for open cutting is simple and could be used repeatedly without being pulled down and then reassembled. Suspension appliance and bracing appliance are operated through an oil pressure system, therefore the operation is safe.

2. The compact size of the equipment results in a simple and neat operation space, and less operation space is needed.

3. The bracing operation is much more efficient and safer because of the use of the raft foundation, the suspension appliance, and the bracing appliance, and therefore the lateral movement of the retaining wall and subsidence of the land are restrained.

4. The raft foundation can be used as a work stage for constructing ground floor slab and slabs for all basement floors, and therefore materials and labor consumptions are greatly reduced.

5. As the excavation reaches the desired depth, the raft foundation can be rapidly lowered to the foundation base to restrain bottom heave and rebound.

6. It is safe and strong to use the finished basement floors as a bracing structure.

7. Because the ground floor is made at an early time, it can be used as a work stage, and therefore the basement operation is free from the influence of the weather.

8. It allows the ground construction and the basement construction to be operated at the same time.

9. It is suitable for big scale and deep excavation works, and for the excavation at any irregular base ground or a base ground having an uneven lateral land load.

What is claimed is:

1. An open cutting by floor slab braced retaining wall, comprising steps of:

a. constructing retaining walls, bored Concrete piles and bearing columns;

b. starting the first excavation;

c. constructing a raft foundation;

d. fixing bracing appliances, floor-forms, suspension appliances;

e. constructing a ground floor slab;

f. starting underground excavation;

g. lowering said raft foundation;

h. bracing said raft foundation;

i. constructing a basement floor; and j. repeating the aforesaid steps f, g, h, i until finished, and simultaneously constructing vertical structure including walls and columns according to the progress of the work.

2. The open cutting by floor slab braced retaining wall of claim 1 wherein the procedure of fixing bracing appliances is to fix bracing appliances to the bottom slab of said raft foundation.

3. The open cutting by floor slab braced retaining wall of claim 1 wherein the procedure of fixing bracing appliances is to fix bracing appliances between said raft foundation and said retaining wall.

4. The open cutting by floor slab braced retaining wall of claim 1 wherein the procedure of fixing floor-forms is to fix floor-forms to the top slab of said raft foundation.

5. The open cutting by floor slab braced retaining wall of claim 1 wherein the procedure of fixing suspension appliances is to fix hollow jacks on brackets above said bearing columns to hold one end of prestressing tendons for allowing the opposite end of the prestressing tendons to be anchored in the bottom beam of said raft foundation.

6. The open cutting by floor slab braced retaining wall of claim 1 wherein the step i of constructing a basement floor is to fix floor-forms to the top slab of said raft foundation.

* * * * *